United States Patent [19]

Wiederkehr

[11] Patent Number: 4,735,019

[45] Date of Patent: Apr. 5, 1988

[54] GRINDING HEAD

[76] Inventor: Hans Wiederkehr, Ifangstrasse 107, Rumlang, Switzerland

[21] Appl. No.: 794,284

[22] Filed: Nov. 4, 1985

[30] Foreign Application Priority Data

Nov. 7, 1984 [CH] Switzerland ..... 5342/84

[51] Int. Cl.[4] ..... B24B 19/02

[52] U.S. Cl. ..... 51/166 MH; 51/93

[58] Field of Search ..... 51/166 MH, 93, 166 R, 51/170 T; 125/14

[56] References Cited

U.S. PATENT DOCUMENTS 2,365,232 12/1944 Wert ..... 51/170 T 4,083,152 4/1978 Lorenz ..... 51/166 MH

FOREIGN PATENT DOCUMENTS 1038041 5/1953 France ..... 51/93

*Primary Examiner*—Roscoe V. Parker

*Attorney, Agent, or Firm*—Bachman & LaPointe

[57] ABSTRACT

The grinding head has a bar-like member, on whose free end is mounted a grinding tool with a grinding wheel spindle arranged at right angles to the longitudinal axis of the bar-like member. The grinding tool is driven by means of a work gear and a driving shaft, which is driven by means of a coupling with a motor. The motor is mounted in a casing, which is shaped onto the mounting flange. The grinding head can be vertically or horizontally arranged in the grinding or milling machine. Due to the fact that the grinding tool has a larger diameter than that of the bar-like member, facing groove sides in bores can be worked in one setting, so that the complete working operation is made faster due to the few idle strokes and simultaneously precision is increased.

3 Claims, 2 Drawing Sheets

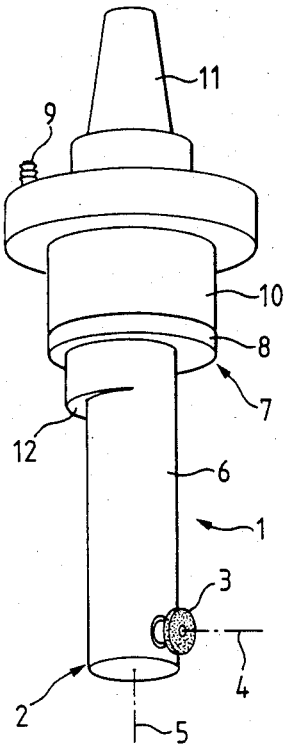
FIG. 1
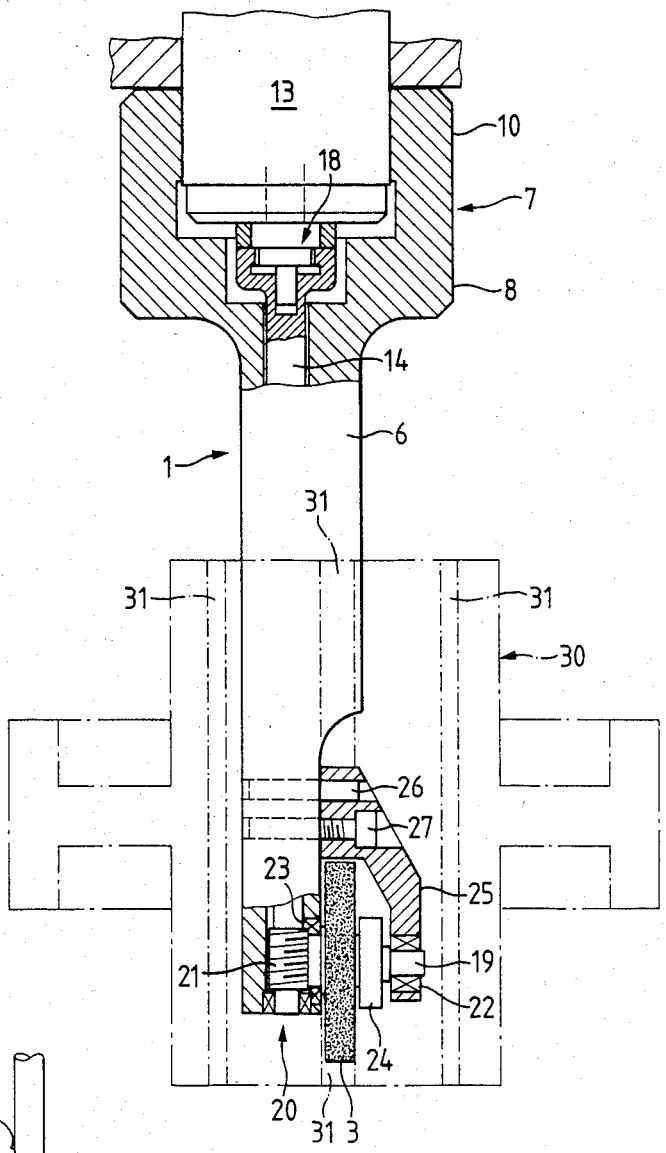
FIG. 2
FIG. 3 a
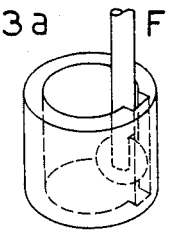
FIG. 3 b
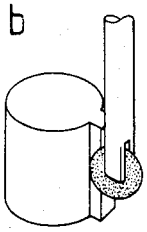
FIG. 3 c
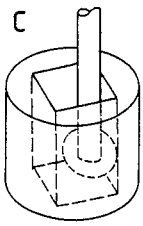
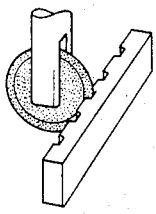
FIG. 3d FIG. 4
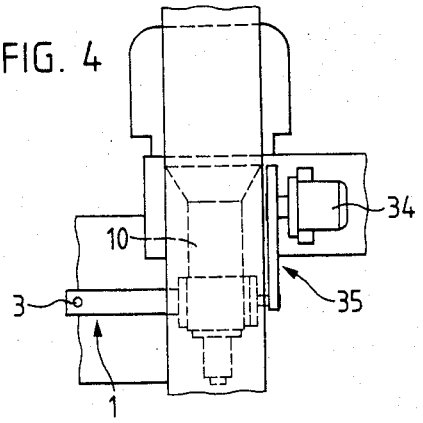
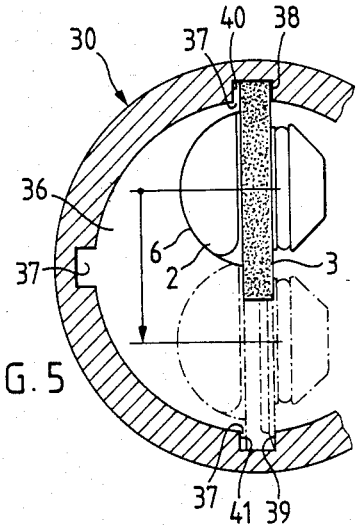
FIG. 5
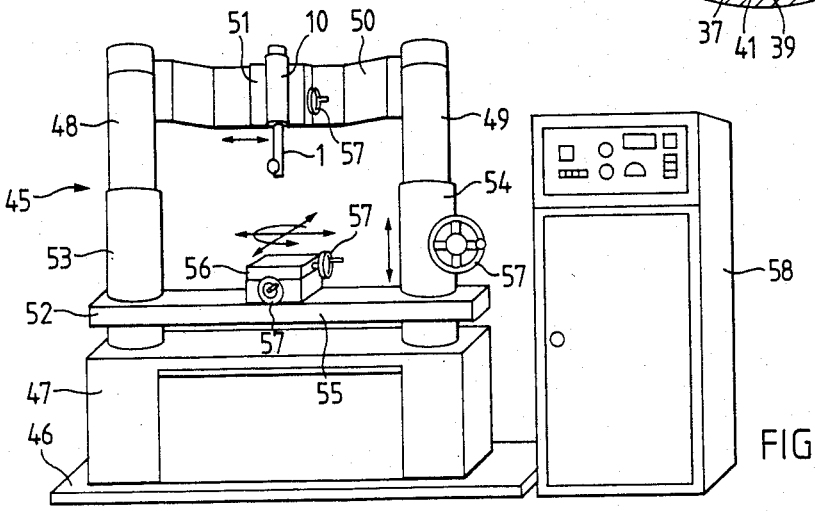
FIG. 6
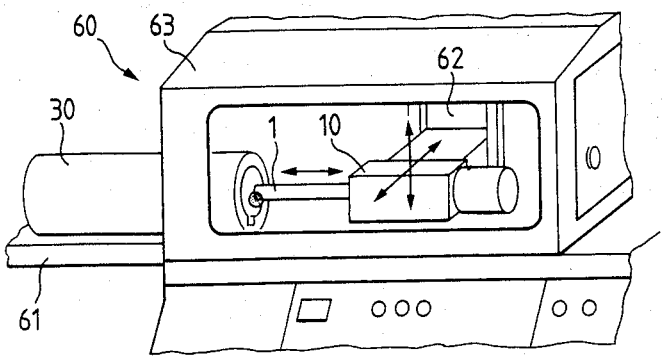
FIG. 7

GRINDING HEAD

BACKGROUND OF THE INVENTION

The present invention relates to a grinding head for grinding grooves and other depressions, in which a mount for a rotary grinding tool and driving members for driving the latter are housed, the grinding head being fixed to a support part, as well as a method for operating said grinding head and to a machine for the same.

For the purpose of making grooves and other depressions, particularly broaching and slotting are used. Both methods are subject to relatively narrow limitations, because workpieces made from high-strength material or even hardened material cannot be worked therewith.

Further disadvantages of these two working methods are described in the simultaneously filed Swiss Patent Application No. 05 341/84 and reference is expressly made thereto as part of the present industrial property right.

SUMMARY OF THE INVENTION

The problem of the present invention is to construct a grinding head of the aforementioned type that, while avoiding the disadvantages of the known prior art, which is possible to make grooves and depressions in an accurate, continuous manner, even in narrow bores.

According to the invention this problem is solved by providing a grinding head comprising an elongated bar-like hollow member having a free end and a drive end disposed along the axis of the elongated bar-like hollow member, a rotary grinding tool mounted in said free end for rotational movement about an axis substantially perpendicular to the axis of said elongated bar-like hollow member and drive means extending from the drive end toward the free end of said elongated bar-like hollow member for rotating said grinding tool.

The invention also covers a method for operating the grinding head according to the invention when grinding grooves in bores and this problem is solved in an optimum manner in that in one workpiece setting initially the first facing sides or flanks of the two facing grooves are formed and in a second workpiece setting the two other facing flanks or sides of said grooves are formed.

The invention also covers a machine ensuring the optimum use of the grinding head. This problem is solved in that on the one hand there is a fixed support in the form of a tool support on which is displaceably mounted the grinding head and on the other hand there is a support guided adjustably with respect to the distance from the fixed support as a worktable for the workpiece.

Appropriately the tool support is a horizontal yoke fixed to the ends of two vertical columns and on which the grinding head is displaceably mounted in the longitudinal direction of the yoke and the worktable is guided in vertically displaceable manner on the two columns, the worktable being equipped with a single or cross-slot and preferably with an indexing attachment.

BRIEF DESCRIPTION OF THE DRAWINGS

The invention is described in greater detail hereinafter relative to non-limitative embodiments and the attached drawings, wherein FIG. 1 is a diagrammatic view of a grinding head assembled with a casing having a gear.

FIG. 2 is a diagrammatically represented longitudinal section through a further grinding head.

FIGS. *3a–3d* are examples of the use of the grinding head according to FIG. 2, FIG. *3a* showing the grinding of an internal groove, FIG. *3b* the grinding of an external groove, FIG. *3c* the grinding of a square bore and FIG. *3d* the grinding of a depression.

FIG. 4 is a diagrammatically represented plan view of a milling machine, to which is attached a grinding head assembled with a casing.

FIG. 5 is a view of the lower end of the grinding head according to FIG. 2 in two positions, for illustrating the method for grinding grooves in bores.

FIG. 6 is a diagrammatically represented side view of a grinding machine with a horizontal worktable and a grinding head arranged above the same.

FIG. 7 is a side view of another grinding machine with a horizontally arranged grinding head.

DETAILED DESCRIPTION OF THE PREFERRED EMBODIMENTS

The grinding head 1 shown in FIG. 1 is provided at its free end 2 with a grinding tool 3, whose rotation axis 4 is at right angles to the longitudinal axis 5 of a bar-like member 6 of grinding head 1. Member 6 is provided at its drive-end 7 with a mounting flange 8, to which is fixed a casing 10, such as by screwing, and forms a support part for grinding head 1. In bar-like members 6 are provided driving members for driving the grinding head 3, as will be described hereinafter. Casing 10 contains further driving members, which cooperate with the driving members of grinding head 1, and permit the connection to a motor drive in a working machine. In the vicinity of mounting flange 8, where the driving members of grinding head 1 are connected to further driving members of casing 10, it may be necessary to provide a bulge 12 in member 6. However, this does not impair the suitability of member 6 for introducing grinding tool 3 into narrow bores. By means of a coolant connection 9, a coolant medium is supplied to grinding head 1 for cooling the tool and removing chips.

On the end of casing 10 remote from grinding head 1 is placed a drive taper 11, such as a morse taper, which brings about the connection to the machine-side driving members.

The grinding head 1 shown in FIG. 2 is provided at its drive-side 7 with a mounting flange 8, which is integrally connected with casing 10. Casing 10 contains a further driving member in the form of a high frequency motor 13, with liquid circulation cooling, which is connected to a geared coupling 18 mounted in rotary manner on a driving shaft 14 in bar-like member 6. Driving shaft 14 extends eccentrically to member 6 and drives a grinding wheel spindle 19 with grinding tool 3, that is a grinding wheel, by means of a screw mechanism 20, whereof the gear 21 located on driving shaft 14 is visible in FIG. 2, while the gear below it located on grinding wheel spindle 19 is not visible. Spindle 19 is mounted in bearings 22, 23, they are antifriction bearings, between which the grinding tool 3 is held by a friction disk 24. Bearing 22 is mounted in an arm 25, which is fixed to the bar-like member 6 by means of a pin 26 of screws 27 thereon.

FIG. 2 shows a workpiece 30 in broken line form, into whose bore is inserted the grinding tool 1 and makes grooves 31, as will be explained in detail relative to FIG. 5. FIG. 3 shows some of the machining or working examples performable with the grinding head according to FIG. 2, (a) showing the grinding of a groove in a bore, (b) an outer rib, (c) a rectangular bore and (d) an external depression.

FIG. 4 shows the fitting of grinding head 1 with grinding tool 3 and casing 10 to a milling machine. The drive can have the same construction as in FIGS. 4 and 5, of the aforementioned parallel industrial property right (Swiss Patent Application No. 05 341/84), the drive taking place from the milling spindle of the milling machine. FIG. 4 shows a solution making it possible to achieve higher speeds. For this purpose an electric motor 34 is mounted on the milling machine arm and drives the driving shaft 14 of grinding head 1 by means of an envelope drive 35, such as a belt drive. This fitting example shows that grinding head 1 can be readily adapted to different machines and drives.

The workpiece 30 shown in FIG. 5 has a bore 36, in which are to be made four grooves 37 (only three are visible), with a grinding head according to FIG. 2, a free end 2 being visible from below. FIG. 5 also shows that the grinding tool 3, that is a grinding wheel, projects laterally from the cross-section of the bar-like member 6 and not only at the bottom as in FIG. 2. This makes it possible to work in the same setting one facing side 38, 39 of two facing grooves 37, it merely being necessary to move the slide carrying workpiece 30 or grinding head 1. If sides 38, 39 are to be worked, workpiece 30 is turned by 180° and then the facing sides 40, 41 are worked in one setting. Through the construction of the grinding head according to FIG. 2, it is possible to achieve an extremely accurate machining of the groove sides with a small number of idle movements.

FIGS. 6 and 7 illustrate grinding machines equipped with the aforementioned grinding heads, the use of such machines being possible if it is necessary to grind large numbers of grooves or other depressions or protuberances.

In FIG. 6 grinding machine 45 has a machine bed 47 supported on a substrate 46, that is a foundation. On machine bed 47 are supported two vertical columns 48, 49, which are firmly connected at their upper ends to a horizontal support 50, on which is mounted a grinding head 1 with a casing head 10 on a horizontally displaceable slide 51. The casing 10 appropriately contains the motor drive as in FIG. 2. A horizontal worktable 52 is guided in vertically displaceable manner in guides 53, 54 on columns 48, 49. To worktable 52 is fixed a cross-slide 55 with an indexing attachment 56 enabling the movements indicated by the arrows to be formed. The vertical displaceability of worktable 52 and the lateral displaceability of guide 51 are also indicated by arrows and represented as manually operated adjusting drives. Cross-slide 55 can also be constructed as a single slide, because it only has to be moved in one direction with grinding head 1 in the case of existing lateral mobility of slide 51. The workpiece mounted on cross-slide 55 and to be worked with grinding head 1 is omitted for reasons of simplicity. Machine bed 47 can carry a drive, such as a hydraulic drive, for the vertical adjustment of worktable 52. A control cabinet 58 is used for controlling and regulating the drive used on machine 45.

The grinding machine 60 shown in FIG. 7 essentially corresponds to grinding machine 45 according to FIG. 6, but is positioned horizontally. Thus, worktable 61 is horizontally and not vertically movable and correspondingly grinding head 1 and casing 10 are horizontally displaceably and not vertically displaceably arranged on a vertical support 62. The displacement possibilities are indicated by an arrow cross. Workpiece 30 is fixed to worktable 61, either directly or by means of a transversely displaceable slide. The movement arrows on grinding head 1 represent the movement direction of worktable 61. The complete working area of grinding machine 60 is covered by a casing 63.

By means of the two above-described grinding machines, it is possible to use grinding head 1 in an optimum manner and with a grinding head according to FIG. 2 it is possible to work two facing groove flanks or slides in the same machine setting.

The milling head described in the aforementioned parallel industrial property right can be used as grinding head 1. In view of the different speeds during milling and grinding, the transmission ratios of the drives, driving members and further driving members in casing 10 can be correspondingly adapted.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. a grinding head comprising:

(a) an elongated cylindrically shaped, bar-like hollow member having a free end and a drive end disposed along the axis of the elongated bar-like hollow member;

(b) a rotary grinding tool mounted in said free end for rotational movement about an axis substantially perpendicular to the axis of said elongated bar-like hollow member, said tool having a diameter greater than the diameter of said hollow member and extending beyond the end face of said free end;

(c) a mounting flange shaped onto the drive end of the hollow member, said mounting flange being connected to a support part constructed as a casing in which are fitted a transmission means for transmitting motion to a drive means; and (d) drive means extending from the drive end toward the free end of said elongated bar-like hollow member for rotating said grinding tool, said drive means comprising a motor drive mounted into the casing substantially adjacent said flange and coupled to a longitudinal shaft eccentrically mounted within a bore in the bar-like member and to gear means positioned between said longitudinal shaft and said grinding tool for driving a spindle upon which said tool is mounted and thereby rotating said tool.

2. A grinding head in accordance with claim 1 wherein said spindle has a first end mounted within said hollow member and a second end mounted in an arm secured to said hollow member.

3. A grinding machine comprising:

(a) a fixed support comprising a horizontal yoke member fixed to the ends of two vertical columns;

(b) a grinding tool displaceably mounted in the longitudinal direction on said horizontal yoke of said fixed support; and (c) a work table displaceably mounted on said vertical columns and spaced from said horizontal yoke and adjustably with respect to said horizontal yoke for regulating the space between, said work table including a slide and indexing attachment for permitting the table to move along two perpendicular axes which lie in a first plane and to rotatae about an axis substantially transverse to said two axes.

* * * * *